United States Patent [19]

Johnson

[11] 3,954,221

[45] May 4, 1976

[54] EASY PACKING DEEP CONTAINER

[75] Inventor: Prentice W. Johnson, Spartanburg, S.C.

[73] Assignee: Container Corporation of America, Chicago, Ill.

[22] Filed: July 17, 1975

[21] Appl. No.: 596,806

[52] U.S. Cl. ..... 229/37 R; 229/17 R
[51] Int. Cl.[2] ..... B65D 5/16; B65D 5/72
[58] Field of Search ..... 229/37 R, 17 R, 7 R, 229/23 R

[56] References Cited

UNITED STATES PATENTS

| | | | |
|---|---|---|---|
| 3,666,167 | 5/1972 | Watts | 229/37 R |
| 3,771,714 | 11/1973 | Faires et al. | 229/37 R |
| 3,827,622 | 8/1974 | McLoud | 229/37 R |
| 3,866,750 | 2/1975 | Collin | 229/17 R X |
| 3,891,137 | 6/1975 | Ellison et al. | 229/23 R X |

*Primary Examiner*—Davis T. Moorhead
*Attorney, Agent, or Firm*—Carpenter & Ostis

[57] ABSTRACT

An easy packing deep container formed of paperboard and having a front wall formed of a pair of overlapping panels with diverging score lines to permit a portion of the front wall to be folded outwardly to facilitate loading of the container.

2 Claims, 4 Drawing Figures

EASY PACKING DEEP CONTAINER

SUMMARY OF THE INVENTION

The invention is directed to that type of container which is of such a depth that the bottom is out of reach of a normal size packer. The container is so formed and arranged that the packer has ready access to the inner bottom for loading and unloading thereof. Such access is made possible by providing a reclosable opening in the front wall of the container.

The invention represents an improvement in the structure disclosed in U.S. Pat. No. 3,771,714 which discloses the concept of providing a front wall formed from a pair of overlapping panels which have diverging fold lines forming a V-shaped opening when the upper center portion of the front wall is folded outwardly for loading or unloading.

The specific structure disclosed in U.S. Pat. No. 3,771,714 provides for overlapping marginal portions of the front wall panels to be adhesively secured to each other only at the lower portion of the front wall; however, with existing standard manufacturing equipment, it is extremely difficult, if not practically impossible, to lay down a precise glue pattern wherein only the lower portion is glued.

It is therefore an object of this invention to provide, in a container of the type described, a structural arrangement which can be easily formed and glued on standard manufacturing equipment.

A more specific object of the invention is to provide front wall panels with overlapping marginal portions, one of which is recessed to prevent the application of adhesive to the upper portion thereof.

Another specific object of the invention is the provision of a second or further recess in the marginal area of one of the panels at the upper extremity thereof to reduce the overall thickness when the container top is closed with an overcap.

These and other objects of the invention will be apparent from an examination of the following description and drawings.

THE DRAWINGS

Figure 1:
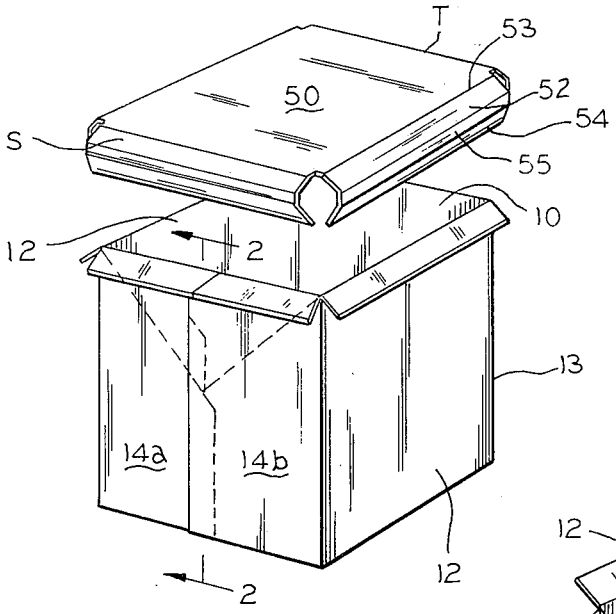
FIG. 1 is an exploded perspective view of a container and interlocking cover embodying features of the invention.
Figure 4:
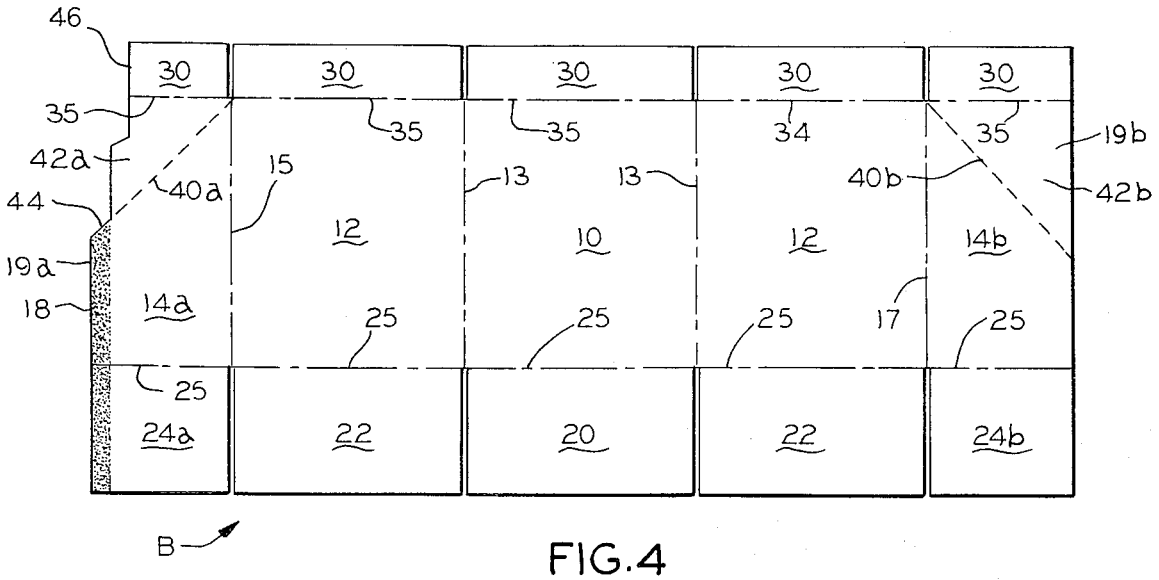
FIG. 4 is a plan view of a blank of foldable paperboard from which the container of the other views may be formed.

It will be understood that, for purposes of clarity, certain elements may have been intentionally omitted from certain views where they are illustrated to better advantage in other views;

Referring now to the drawings for a better understanding of the invention and first to FIG. 1, it will be seen that the novel container embodying features of the invention includes an open top container body indicated generally at C which may be formed from a unitary blank of foldable paperboard indicated generally at B and shown in FIG. 4 of the drawings.

The container may also include a conventional interlocking cover indicated generally at T which may be secured in position in a manner hereinafter described by means of a band or strap indicated generally at S.

As best seen in FIGS. 1 and 4, container body C includes a pair of opposed front and rear major side walls 10 and 14, respectively, and a pair of opposed minor side walls 12 which are foldably connected at their rear edges to side edges of rear side wall 10 along vertical fold lines 13.

Front wall 14 includes a pair of generally coplanar inner and outer front panels **14*a* and 14*b*, respectively, which are foldaably connected at their remote side edges along vertical fold lines 15 and 17, respectively, to the front edges of related minor side walls 12**.

The front panels **14*a* and 14*b* have marginal portions next to their adjacent side edges which are disposed in overlapping relationship and with the lower sections of the marginal portions 19*a* and 19*b*** adhesively secured to each other in a manner hereinafter described.

In the embodiment illustrated in the drawing, container body C is in tubular form open at the top and with its lower end closed by a plurality of bottom closure flaps folded over into overlapping relationship and secured to each in a conventional manner. The closure flaps include flap 20 foldably connected to the lower end of rear side wall 10, closure flaps 22 foldably connected to the lower ends of minor side walls 12, and closure flaps **24*a* and 24*b* foldably connected to the lower ends of front side wall inner and outer panels 14*a* and 14*b*. All the closure flaps are connected to their respective vertical walls along common horizontal fold lines 25. In the container illustrated in the drawings, there are foldably joined to the upper edges of rear side wall 10, minor side walls 12, and front wall inner and outer panels 14*a* and 14*b*, a plurality of relatively narrow flanges 30, which are foldably connected to the vertical walls along common horizontal fold lines 35**. The purpose of the flanges is for interlocking engagement with a separate cover in a manner hereinafter described.

Panels **14*a* and 14*b* of front wall 14 are provided with diverging fold lines 40*a* and 40*b*, respectively, which extend diagonally upward from a point near the center of the front wall 14 to the upper corners of said front wall to define a pair of generally triangular-shaped subpanels 42*a* and 42*b***, respectively, the purpose of which is hereinafter described.

Figure 2:
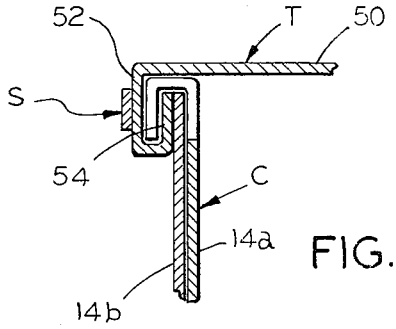
FIG. 2 is a fragmentary vertical section taken on line 2—2 of FIG. 1, with the cover shown in closed, interlocking relation with the container.
Figure 3:
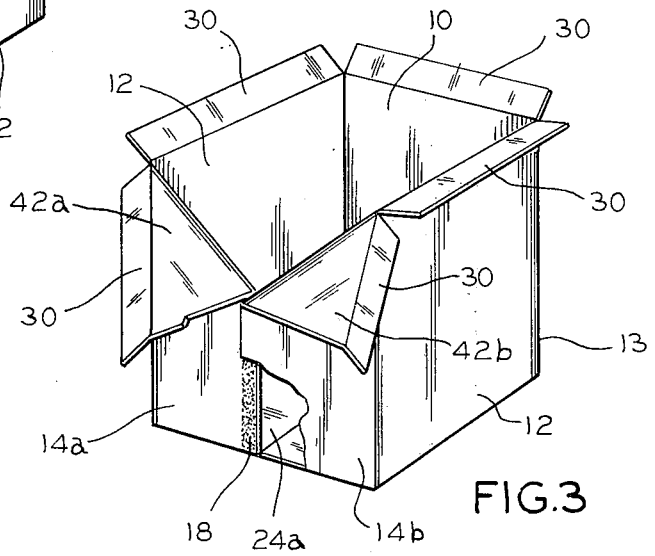
FIG. 3 is a perspective view of the container illustrated in FIG. 1, with the front wall panels shown folded to the open position.

Returning to the cover arrangement, it will be seen from examination of FIGS. 1 and 2 that the separate cover T includes a generally rectangular top wall 50 which has a plurality of flange members depending therefrom for interlocking engagement with the flanges of the container body. Each of the flange members includes an outer flange 52 foldably connected to the cover on fold line 53 and extending downwardly therefrom and an inner flange 54 foldably connected to the lower edge of related flange 52 along a fold line 55 and extending upwardly therefrom to provide a pocket for receiving the related downwardly extending flanges 30 of the container body as best illustrated in FIG. 2. The flanges may be snugly enclosed by a peripheral strap or band indicated generally at S to provide a complete interlocking relationship between the container cover and body.

It will be understood that the separate cover arrangement may be used at either end of the container, if desired. It is to be further understood that the concept of the interlocking flanges on the cover is old in the art and not part of this invention except for its relationship with the recesses in the front wall inner panel as hereinafter described.

The purpose of the front wall construction in this invention wherein the panels 42*a* and 42*b* which are defined by the diagonal fold lines 40*a* and 40*b* is to permit the front wall of the container to be opened so that the person packing the container will have easy access to the bottom of the container. This is especially important in the case of a large and bulky container. The fold lines 40*a* and 40*b* permit the subpanels 42*a* and 42*b*, respectively, to be folded forwardly out of the plane of the front wall for loading, then to be folded back into the plane of the front wall for reclosing. Although this basic concept of providing a V-shaped opening in the front wall of a container was disclosed in U.S. Pat. No. 3,771,714, it was discovered that the patented construction could not be formed on box forming and adhesive apply mechanisms because in order for the box to work satisfactorily, the adhesive pattern 18 must only be applied to the lower portion of the container between the overlapping marginal portions of the front wall panels.

The novelty in this invention resides in the provision of a recessed marginal portion of the front wall inner panel 14*a*, wherein it will be seen that the inner panel marginal portion has its upper section cut back as at 44 from its lower section, so that when a pattern line of adhesive is machined applied to the periphery of the lower section, the upper section will remain free from adhesive to permit the subpanels to be folded outwardly and away from each other to provide easy access for loading the container. Thus, this arrangement makes it possible to mass produce containers of this type in a manner which is not possible for the containers disclosed in the previously patented construction.

Additionally, it will be noted that the front wall inner panel 42*a* is further cut back adjacent its upper extremity to remove the remaining part of the marginal portion upper section and thereby reduce the thickness of the material in the container body adjacent the flanges of the container body and cover. This permits a tighter and more satisfactory closure of the upper end of the container body.

I claim:

1. An easy packing deep, shipping container formed from foldable paperboard, comprising:

a. a container body having a bottom wall, an opposed pair of front and rear major side walls, and an opposed pair of minor side walls foldably connected to each other and to said bottom wall and upstanding therefrom to form a box-like enclosure open at the top;

b. said side walls having locking flanges foldably connected to their upper edges and extending outwardly and downwardly therefrom;

c. a cover having a top wall with locking flanges foldably connected to the side edges thereof and arranged and disposed for interlocking engagement with the locking flanges of said body;

d. said body front wall comprising a pair of generally co-planar inner and outer front panels foldably connected at their outboard edges to side edges of related minor side walls and having, adjacent their inboard edges, marginal portions disposed in overlapping relation;

e. said panels presenting diverging score lines which extend from a point located near the center of said front wall to the upper corners of said front wall to define a pair of generally triangular-shaped subpanels which are foldable outwardly from the plane of said front wall along said score lines to facilitate loading of said container and which are foldable back into the plane of said front wall after completion of loading;

f. said inner panel marginal portion having its upper section cut back from its lower section, so that when adhesive is machine applied to the periphery of said lower section, said upper section will remain free from adhesive to permit said sub-panels to be folded outwardly for loading of the container;

g. said inner panel being further cut back adjacent its upper extremity to remove the remaining part of said marginal portion upper section and thereby reduce the thickness of the material in the container body adjacent the flanges of said container body and cover.

2. An easy packing deep, shipping container formed from a unitary blank of foldable paperboard, comprising:

a. a container body having a bottom wall, an opposed pair of front and rear major side walls, and an opposed pair of minor side walls foldably connected to each other and to said bottom wall and upstanding therefrom to form a box-like enclosure open at the top;

b. said body front wall comprising a pair of generally co-planar inner and outer front panels foldably connected at their outboard edges to side edges of related minor side walls and having, adjacent their inboard edges, marginal portions disposed in overlapping relation;

c. said panels presenting diverging score lines which extend from a point located near the center of said front wall to the upper corners of said front wall to define a pair of generally triangular-shaped subpanels which are foldable outwardly from the plane of said front wall along said score lines to facilitate loading of said container and which are foldable back into the plane of said front wall after completion of loading;

d. said inner panel marginal portion having its upper section cut back from its lower section, so that when adhesive is machine applied to the periphery of said lower section, said upper section will remain free from adhesive to permit said sub-panels to be folded outwardly for loading of the container.

* * * * *